US005365910A

United States Patent [19]

Miyata et al.

[11] Patent Number: 5,365,910

[45] Date of Patent: Nov. 22, 1994

[54] MISFIRE DETECTOR FOR USE IN INTERNAL COMBUSTION ENGINE

[75] Inventors: Shigeru Miyata; Hideji Yoshida; Yoshihiro Matsubara; Yasuo Ito, all of Nagoya, Japan

[73] Assignee: NGK Spark Plug Co., Ltd., Nagoya, Japan

[21] Appl. No.: 865,910

[22] Filed: Apr. 9, 1992

[30] Foreign Application Priority Data

| | | | |
|---|---|---|---|
| May 14, 1991 | [JP] | Japan | 109098 |
| Jun. 5, 1991 | [JP] | Japan | 134458 |
| Jul. 3, 1991 | [JP] | Japan | 163129 |
| Oct. 1, 1991 | [JP] | Japan | 252679 |

[51] Int. Cl.[5] ..... F02P 17/00

[52] U.S. Cl. ..... 123/627; 123/655; 73/116; 324/399

[58] Field of Search ..... 123/630, 655, 627; 324/399; 73/116, 117.3

[56] References Cited

U.S. PATENT DOCUMENTS

| | | | |
|---|---|---|---|
| 3,942,102 | 3/1976 | Kuhn et al. | 324/399 |
| 4,117,807 | 10/1978 | Barnard | 123/630 |
| 4,138,710 | 2/1979 | Tsukuru | 123/655 |
| 4,987,771 | 1/1991 | Iwata | 73/117.3 |
| 5,046,470 | 9/1991 | Entenmann et al. | 123/630 |

FOREIGN PATENT DOCUMENTS

| | | | |
|---|---|---|---|
| 305347 | 3/1989 | European Pat. Off. . | |
| 60-198377 | 10/1985 | Japan | 123/630 |
| 2-102376 | 4/1990 | Japan | 123/655 |
| 2071935 | 9/1981 | United Kingdom . | |
| 2116329 | 9/1983 | United Kingdom . | |

*Primary Examiner*—Andrew M. Dolinar
*Attorney, Agent, or Firm*—Cooper & Dunham

[57] ABSTRACT

A misfire detector for use in an internal combustion engine has an ignition coil including a primary coil and a secondary coil. An interrupter circuit is provided for on-off actuation of primary current flowing through a primary circuit of the ignition coil. A distributor has a series gap provided in a secondary circuit of the ignition coil, and a spark plug is adapted to be energized from the ignition coil through the series gap of the distributor. A voltage charging circuit works to electrically charge a stray capacity inherent in the spark plug immediately after an end of a spark action of the spark plug. A spark plug voltage detector circuit distinguishes the voltage waveform of more than a predetermined reference voltage level so as to deform the voltage waveform into output signals. On the basis of the width of the output signals, a distinction circuit determines whether or not the spark action ignites an air-fuel mixture in a cylinder of the internal combustion engine.

4 Claims, 6 Drawing Sheets

MISFIRE DETECTOR FOR USE IN INTERNAL COMBUSTION ENGINE

BACKGROUND OF THE INVENTION

Field of the Invention

This invention relates to a misfire detector for use in internal combustion engine which is based on the fact that an electrical resistant of the spark plug gap is distinguishable between the case when spark ignites air-fuel mixture gas, and the case when the spark fails to ignite the air-fuel mixture gas injected in a cylinder of the internal combustion engine.

With the demand of purifying emission gas and enhancing fuel efficiency of internal combustion engine, it has been necessary to detect firing condition in each cylinder of the internal combustion engine. In order to detect the firing condition in each of the cylinders, an optical sensor has been installed within the cylinders on one hand. Otherwise, a piezoelectrical sensor has been attached to a seat pad of the spark plug. Otherwise ion current flowing through an ignition circuit has been detected.

In either case, it is troublesome and time-consuming to install the sensor to each of the cylinders, thus increasing the installation cost, and at the same time, taking much time in check and maintenance.

Therefore, it is an object of the invention to provide a misfire detector for use in internal combustion engine which is capable of precisely detecting waveform of a secondary voltage applied to the spark plug installed to each cylinder of the internal combustion engine with a relatively simple structure.

SUMMARY OF THE INVENTION

According to the present invention, there is provided a misfire detector for use in internal combustion engine comprising: an ignition coil having a primary coil and a secondary coil; an interrupter means which on-off actuates primary current flowing through a primary circuit of the ignition coil; a series gap or check diode provided in a secondary circuit of the ignition coil; a spark plug provided with an internal combustion engine; a voltage charging means which works to electrically change stray capacity inherent in the spark plug immediately after an end of the spark action of the spark plug; a secondary voltage characteristic detector means (spark plug voltage characteristic detector means) which detects an attenuation time period of the secondary voltage (spark plug voltage); and a distinction circuit which determines on the basis of the attenuation time period whether or not the spark plug ignites air-fuel mixture injected in a cylinder of the internal combustion engine.

Such is the structure of the present invention that energy from the stray capacity inherent in the spark plug is released to provide the secondary voltage after the end of the spark action. The attenuation characteristics of the changed capacity changes depending upon whether or not ionized particles present in the combusion gas in the spark gap of the spark plug. Therefore, it enables to detect a misfire by detecting the attenuation characteristics and compare it with an attenuation characteristics which is previously determined by experiment or calculation. It is possible to provide a misfire detector which is capable of eliminating the necessity of an optical sensor, pressure sensor or high voltage diode, and superior in mounting on the engine, simple structure.

According to anoter invention, the misfire detector further comprising: a voltage charging means which on-off actuates the primary current of the ignition coil either during establishing the spark between electrode of the spark plug or during a predetermined period of time immediately after the end of the spark action of the spark plug, and generating an electromotive voltage in the secondary circuit to electrically charge the stray capacity inherent in the spark plug; a shunt voltage detector means (voltage detector means) provided to divide the secondary voltage (spark plug voltage) to present a shunt voltage; a secondary voltage characteristic detector means (spark plug voltage characteristic detector means) which detects the attenuation time period of the secondary voltage (spark plug voltage); and a distinction circuit which determines on the basis of the attenuation time period whether or not the spark ignites air-fuiel mixture injected in a cylinder of an internal combustion engine.

In this invention, the primary current flows through the primary circuit of the ignition coil for a short period of time either during inductive discharge period of the sparking action or after the end of the inductive discharge period. After interrupting the primary current, the secondary voltage (misfire detecting secondary voltage) is elevated again in which a level of the reelevated voltage is controlled to be 5~7 KV which is high enough to break dowm the series gap such as a rotor gap of the distributor. At this time, the charging voltage is applied across the spark plug to electrically charge the stray capacity inherent in the spark plug. Discharging time length of the charged capacity changes depending on whether or not ionized gas appears in the combustion gas staying in the spark gap when the spark ignites the air-fuel mixture gas in the cylinder.

Therefore, by detecting the attenuation time length of the secondary voltage after the spark is interrupted, it is possible to determine whether or not the spark ignites air-fuel mixture injected in a cylinder of an internal combustion engine. This makes it possible to obviate the necessity of the optical sensor, high voltage diode and the piezoelectrical sensor, thus enabling to provide a misfire detector simple in structure and readily reducible to practical use.

With an addition of the diode which allows current to flow from the secondary coil to the series gap of the distributor, and prohibiting the current to flow backward, characteristics of the attenuation time period of the secondary voltage is improved to enable precise detection on whether misfire occurs or not.

These and other objects and advantages of the invention will be apparent upon reference to the following specification, attendant claims and drawings.

DETAILED DESCRIPTION OF THE EMBODIMENTS

Figure 1:
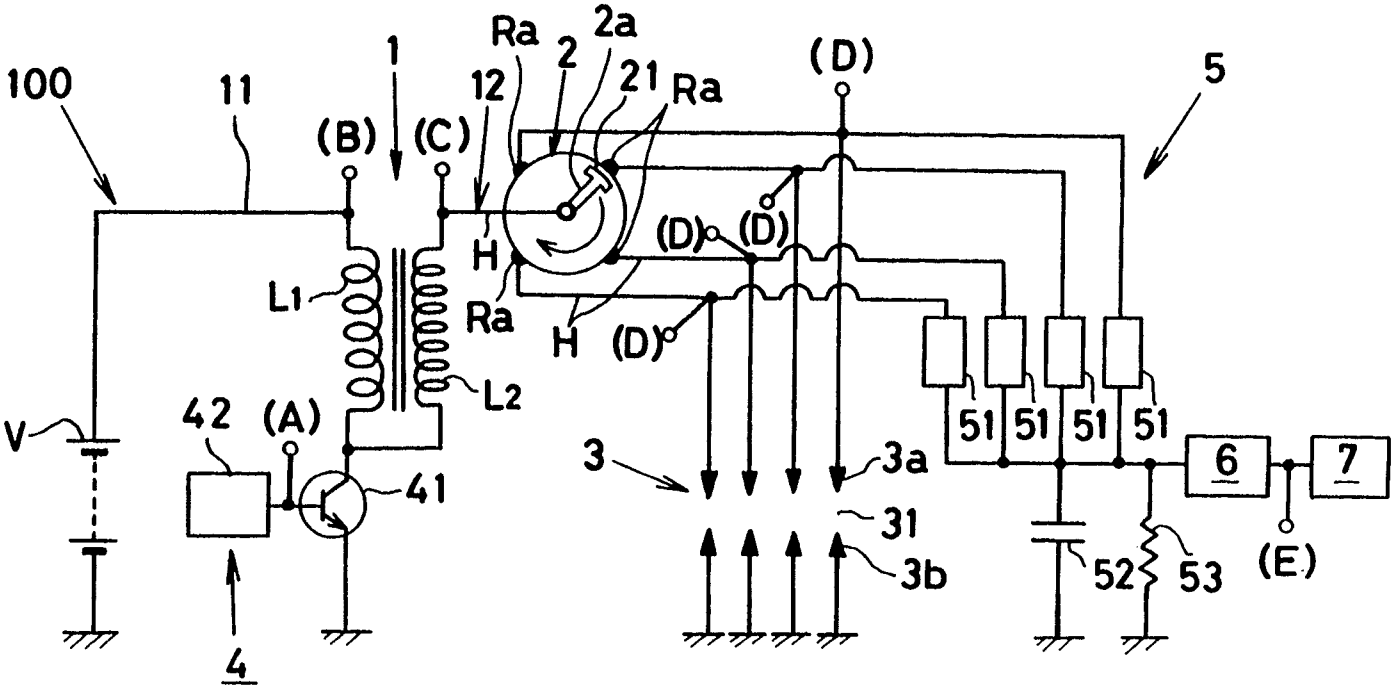
FIG. 1 is a schematic view of an ignition coil in which a misfire detector is incorporated according to one embodiment of the invention.

Referring to FIG. 1 which shows a misfire detector 100 which is incorporated into an internal combustion engine, the misfire detector 100 has an ignition coil 1 which includes a primary circuit 11 and a secondary circuit 12 with a vehicular battery cell (V) as a power source. The primary circuit 11 has a primary coil (L1) electrically connected in series with a switching device 41 and a signal generator 42, while the secondary circuit 12 has a secondary coil (L2) connected to a rotor 2*a* of a distributor 2. The distributor 2 has stationary segments (Ra), the number of which corresponds to that of the cylinders of the internal combustion engine. To each the stationary segments (Ra), is an free end of the rotor 2*a* adapted to approaches so as to make a rotor gap 21 (series gap) with the corresponding segments (Ra). Each of the segments (Ra) is connected to a spark plug 3 by way of the high tension cord (H). The spark plug 3 has a center electrode 3*a* and an outer electrode 3*b* to form a spark gap 31 between the two electrodes 3*a*, 3*b*, across which spark occurs when energized.

The switching device 41 and the signal generator 42 forms an interrupter circuit 4 which detects a crank angle and a throttling degree of the engine to interrupt primary current flowing through the primary coil (L1) to induce secondary voltage in the secondary coil (L2) of the secondary circuit 12 so that the timing of the spark corresponds to an advancement angle relevant to revolution and burden which the engine bears. The interrupter circuit 4 forms a voltage charging circuit which on-off actuates the primary coil (L1) to induce charging voltage in the secondary circuit 12 either during establishing the spark between the electrodes 3*b* or during a predetermined time period immediately after an end of the spark, thus leading to electrically charging stray capacity inherent in the spark plug 3 itself.

It is noted that a discrete voltage charging circuit may be provided independently of the interrupter circuit 4 as another embodiment of the invention, so that the voltage charging circuit can directly charge the stray capacity inherent in the spark plug 3 immediately after the end of the spark.

Meanwhile, an electrical conductor 51 is disposed around an extension part of the high tension cord (H) define static capacity of e.g. 1 pF therebetween so as to form a shunt voltage divider circuit (voltage divider circuit) 5. The conductor 51 is connected to the ground by way of a shunt condensor 52. To a common point between the conductor 51 and the shunt condensor 52, is a secondary voltage detector circuit (spark plug voltage detector circuit) 6 electrically connected to which a distinction circuit 7 is connected. The shunt condensor 52 has static capacity of e.g. 3000 pF to serve as a low impedance element, and the shunt condensor 52 further has an electrical resistor 53 (e.g. 2 MΩ) connected in parallel therewith so as to form a discharge path for the shunt condensor 52.

The shunt voltage divider circuit 5 allows to divide the secondary voltage induced from the secondary circuit 12 by the order of 1/3000, which makes it possible to determine the time constant of RC path to be approximately 6 milliseconds to render an attenuation time length relatively longer (3 milliseconds) as described hereinafter.

In this instance, the secondary voltage 30000 V divided to the level of 10 V is inputted to the secondary voltage detector circuit 6. The secondary voltage detector circuit 6 detects such a time length as to hold more than a predetermined voltage level in the secondary voltage waveform, so that the distinction circuit 7 determines misfire when the time length is held for more than a predetermined period of time.

Figure 2:
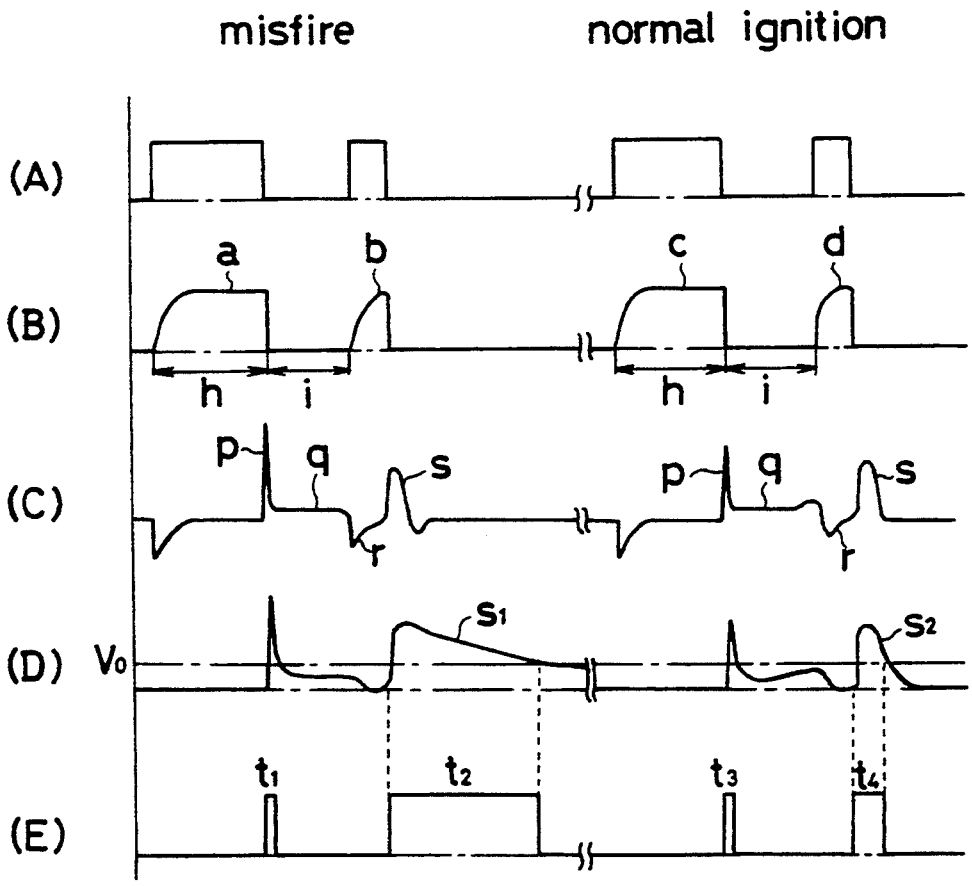
FIG. 2 shows voltage waveform for the purpose of explaining how the secondary voltage detector circuit works.

With the structure thus far described, the signal genera/or 42 of the interrupter circuit 4 outputs pulse signals as shown at (A) in FIG. 2 in order to induce the primary current in the primary circuit 11 as shown at (B) in FIG. 2. Among the pulse signals, the pulses (a), (c) which have a larger width (h) energizes the spark plug 3 to establish the spark between the electrodes 3*a*, 3*b*. The pulses (a), (c) followed by the pulses (b), (d) delays by the time of 0.5~1.5 ms (i). The pulses (b), (d) have a thin width to electrically charge the stray capacity inherent in the spark plug 3.

In so doing, the time length during which the free end of the rotor 2*a* forms the rotor gap 21 with each of the segments (Ra), changes depending on the revolution of the engine. The pulse width (h) and the delay time (i) are determined shorter in a manner that the spark holds for 0.5~0.7 ms when the engine is operating at high revolution (6000 rpm).

With the actuation of the interrupter circuit 4, the secondary voltage (spark plug voltage) appears in the secondary coil (L2) of the secondary circuit 12 as shown at (C) in FIG. 2.

Due to a high voltage (p) established following the termination of the pulse signals (a), (c), the spark begins to occur so as to succeed an inductive discharge waveform (q).

In response to the rise-up pulse signals (b), (d), a counter-electromotive voltage accompanies a positive voltage waveform (r) flowing through the secondary circuit 12, thus making it possible to terminate the spark when the spark lingers. Due to an electrical energy stored in the ignition coil 1 when the primary coil (L1) is energized, the secondary voltage is enhanced again to flow a voltage waveform (s) through the secondary circuit when the primary coil (L1) is deenergized. The enhanced voltage level is determined as desired by the delay time (i) and the width of the pulse signals (b), (d). The level of the voltage waveform (s) is 5~7 KV, the magnitude of which is enough to break down the rotor gap 21, but not enough to establish a discharge between the electrodes 3*a*, 3*b* when free from ionized particles.

The discharge voltage in main from the stray capacity (usually 10~20 pF) inherent in the spark plug 3, is released as shown at (D) in FIG. 2. The attenuation time length of the discharge voltage is distinguishable the case when the spark normally ignites the air-fuel mixture gas from the case when the spark fails to ignite the air-fuel mixture gas injected in each cylinder of the internal combustion engine. That is to say, the misfire follows a slowly attenuating voltage waveform (s1) as shown in FIG. 2, while the normal ignition follows an abruptly attenuating waveform (s2) as shown in FIG. 2. The secondary voltage detector circuit 6 detects a voltage waveform level of more than a reference voltage level (Vo) so as to deform the voltage waveform into square wave pulses t1~t4, each width of which is equivalent to the attenuation time length. The square wave pulses t1~t4 are inputted to the distinction circuit 7 so as to cause the distinction circuit 7 to determine the misfire when the attenuation time length is more than 3 ms (1 ms) with the revolution of the engine as 1000 rpm (6000 rpm). The dinstinction circuit 7 further determines the misfire when the attenuation time length is more than the one decreasing in proportion to the engine revolution which falls between 1000 and 6000 rpm.

In the above embodiment, the rotor gap is used as a series gap of the distributor, however, in a distributorless igniter, a check diode which is usually provided in a secondary circuit serves as the roter gap.

It is preferable that the secondary voltage is maintained positive by reversely connecting the ignition coil 1 since the ionized particles in the air-fuel mixture gas allows electric current to flow better when the center electrode 3*a* is kept positive than otherwisely connected.

Figure 3:
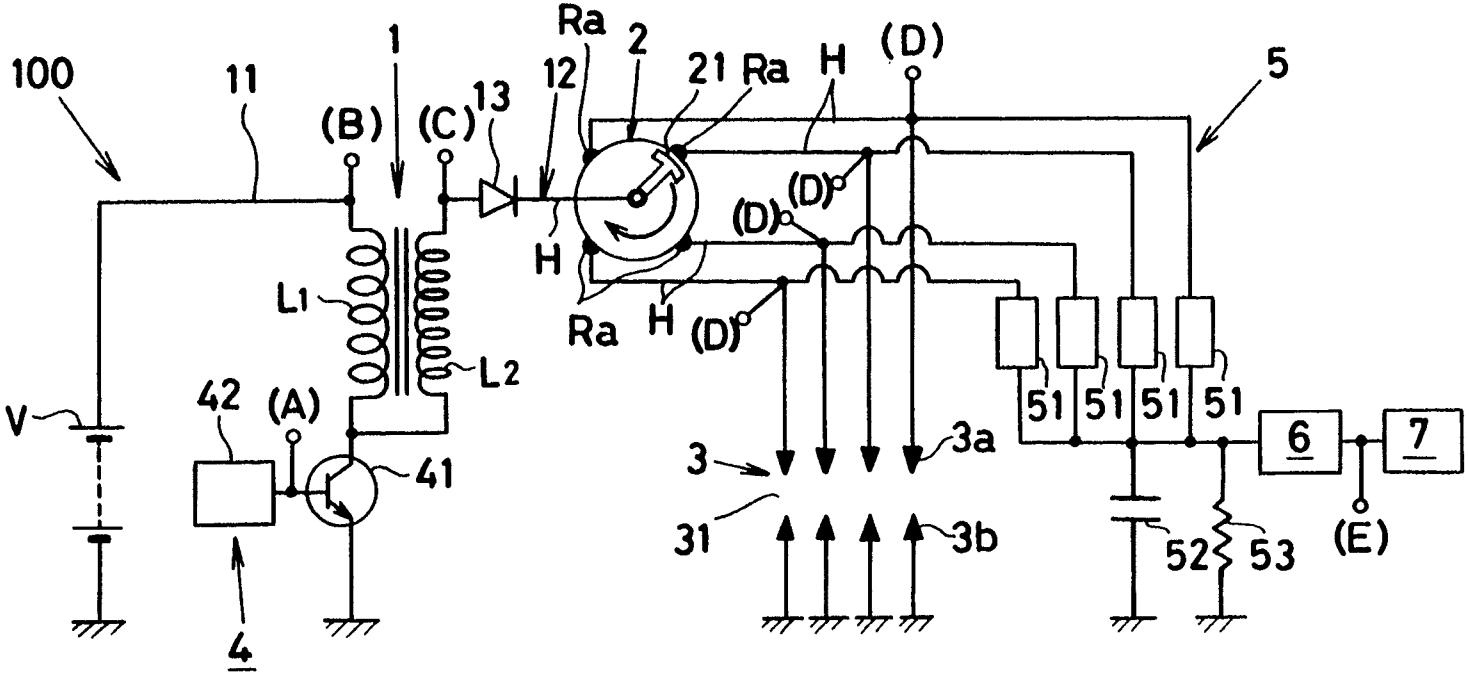
FIG. 3 is a view similar to FIG. 1 according to still another embodiment of the invention.
Figure 4:
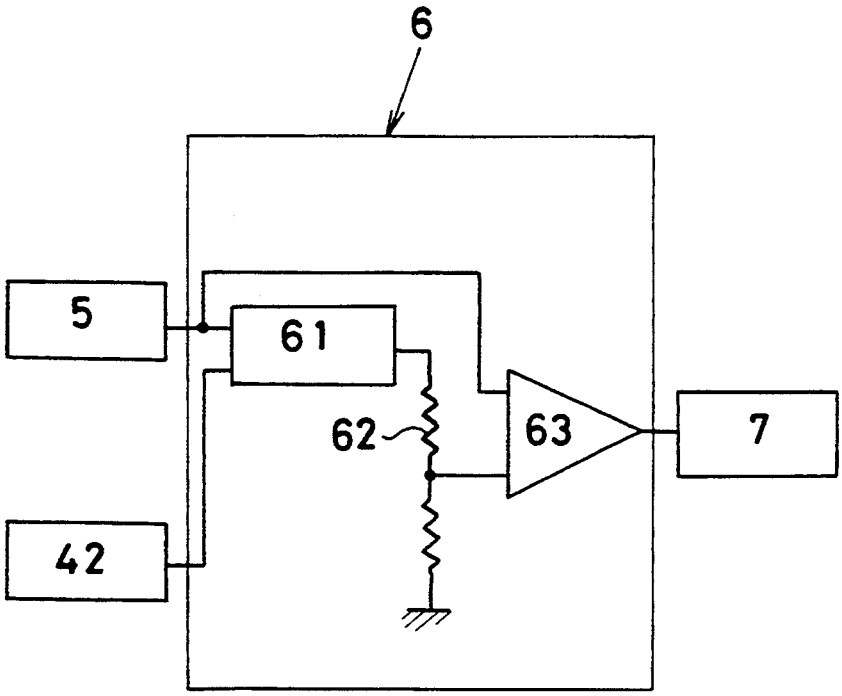
FIG. 4 is a schematic view of a secondary voltage detector circuit.
Figure 5:
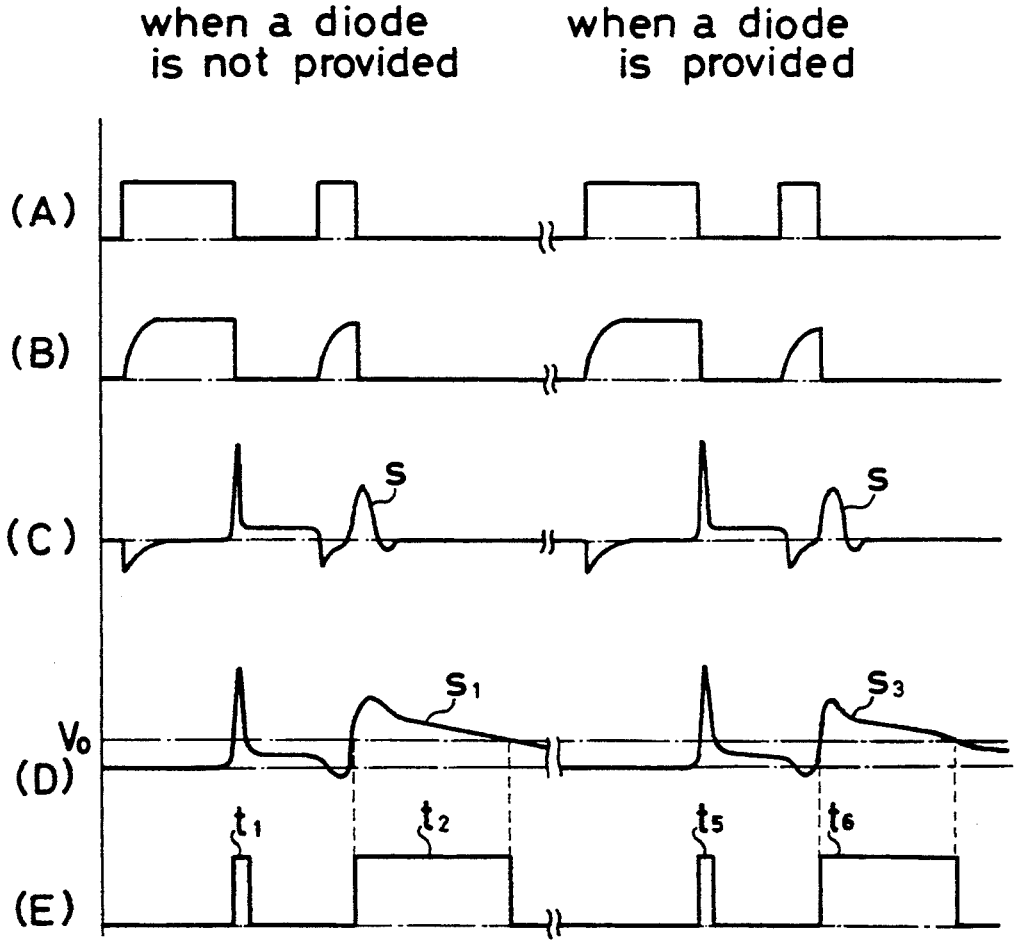
FIG. 5 shows voltage waveform for the purpose of explaining how the waveform changes depending on whether a diode is provided or not.

FIGS. 3, 4 and 5 show still another embodiment of the invention in which a diode 13 is electrically connected between the rotor 2*a* of the distributor 2 and the secondary coil (L2) of the secondary circuit 12. The diode 13 allows electric current to flow from the secondary coil (L2) to the rotor 2*a* of the distributor 2, but prohibits the electric current to flow backward. With the secondary voltage detector circuit 6, are a peak hold circuit 61, a shunt voltage circuit 62 and a comparator 63 provided as shown in FIG. 4. To the peak hold circuit 61, are the input signal (A) of the signal generator 42 and the shunt voltage of the shunt voltage divider circuit 5 inputted. The shunt voltage circuit 62 divides an output voltage from the peak hold circuit 61. The comparator 63 compares the output from the shunt voltage divider circuit 5 with the shunt voltage from the shunt voltage circuit 62 in order to detect a holding time length of an output voltage, the level of which is more than a predetermined level among the divided voltage waveform of the secondary voltage. The distinction circuit 7 determines the misfire by detecting the holding time length longer than a certain period of time.

With the pulse signals (A) which causes to induce the secondary voltage in the secondary circuit 12, the secondary voltage is enhanced again as mentioned hereinbefore when deenergized. The enhanced voltage electrically charges the stray capacity inherent in the spark plug 3 to make a potential difference between the ignition coil 1 and the spark plug 3.

In this instance, the diode 13 prohibits the electric current to flow through the rotor gap 21 in the direction opposite to the spark which occurs from the center electrode 3*a* to the outer electrode 3*b*. Otherwise the voltage waveform (s) shown in FIG. 2 reduces to 3~4 KV so as to deteriorate the precision on detecting the attenuation time length.

With the provision of the diode 13, the secondary voltage accompanies a slowly attenuating voltage waveform (s3) as opposed to that accompanying the rapidly changing voltage waveform (s1) as shown in FIG. 5.

In the secondary voltage detector circuit 6, the peak hold circuit 61 holds a peak voltage based on the stray capacity of the spark plug 3 with $\frac{1}{3}$ of the peak voltage as the reference voltage level (Vo) for example. The comparator 63 compares the reference voltage level (Vo) with the output voltage waveform from the shunt voltage divider circuit 5 so as to output square pulses t5, t6 as shown at (E) in FIG. 5. The square pulses t6 are inputted to the distinction circuit 7 to determine whether the misfire occurs or not.

Figure 6:
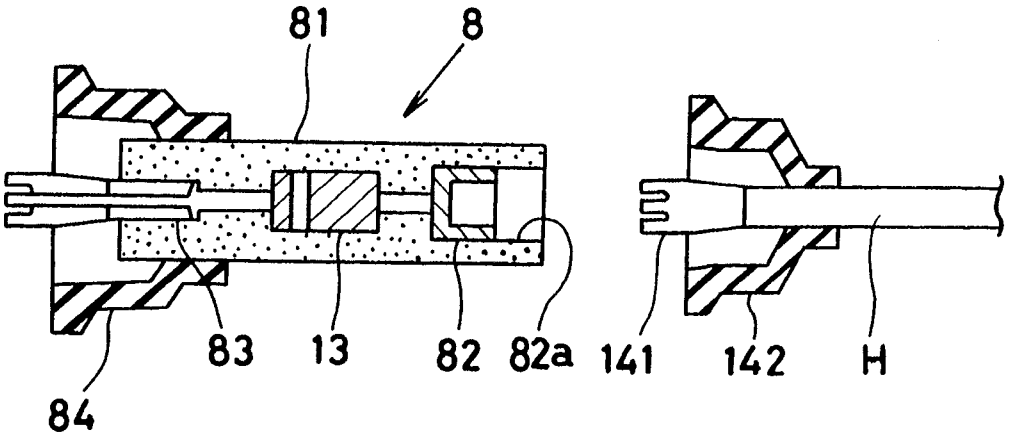
FIG. 6 is an exploded view of a high tension cord adaptor in which the diode is contained.

FIG. 6 shows how the diode 13 is electrically connected between the distributor 2 and the high tension cord (H) of the secondary circuit 12 by way of illustration.

In order to put the electrical connection of the diode 13 into practical use, is a high tension cord adaptor 8 employed which has a resin column body 81 in which the diode 12 is embedded. One end of the diode 13 has a terminal cap 82 embedded in the resin column body 8, while the other end of the diode 13 has a tubular terminal 83 partly extended from the resin column body 81. The terminal cap 82 is exposed to the outside through a bore 82*a* provided in one end of the resin column body 81.

The terminal cap 82 is connected to a connector terminal 141 of the high tension cord (H) through the bore 82*a*, while tubular terminal 83 connected to a center electrode (not shown) of the distributor 2. A terminal connection between the terminal cap 82 and the connector terminal 141 is shielded by a rubber grommet 142 on one hand. On the other hand, a connection portion between the tubular terminal 83 and the center electrode of the distributor 2 is shielded by another rubber grommet 84.

The tension cord adaptor 8 thus assembled is detachably connected between the distributor 2 and the high tension cord (H), thus enabling to easily provide the diode 13 for the purpose of improving the detecting precision of the attenuation time length.

It is appreciated that the column body 81 may be an electrical insulator made of heat-resistant ceramic material instead of the resin.

It is also appreciated that the grommet 84 may be integrally made with the resin column body 8 simultaneously when the resin column body 8 is moulded.

Further, it is noted that the grommet 84 may be arranged to liquid-tightly seal the connection portion between the tubular terminal 83 and the center electrode of the distributor 2, while the grommet 142 may liquid-tightly seal the terminal connection between the terminal cap 82 and the connector terminal 141.

Moreover, it is noted that the resin column body 81 may be rectangular, circular or polygonal in cross section.

While the invention has been described with reference to the specific embodiments, it is understood that this description is not to be construed in a limiting sense in as much as various modifications and additions to the specific embodiments may be made by skilled artisan without departing from the spirit and scope of the invention.

What is claimed is:

1. A misfire detector for use in an internal combustion engine comprising:

an ignition coil having a primary coil and a secondary coil;

an interrupter means which on-off actuates primary current flowing through a primary circuit of the ignition coil;

a current flow-back prevention means provided in a secondary circuit of the ignition coil so as to prevent a current flow back to the ignition coil;

a spark plug provided for an internal combustion engine and adapted to be energized from the coil through the current flow-back prevention means;

a voltage charging means which reenergizes the primary coil to induce an electromotive voltage in the secondary coil so as to electrically charge a stray capacity inherent in the spark plug immediately after an end of a spark action of the spark plug;

a spark plug voltage characteristic detector means which detects an attenuation time period of a voltage waveform derived from a spark plug voltage applied across the spark plug by the voltage charging means; and a distinction means provided to determine a misfire on the basis of the attenuation time period length of the spark plug voltage waveform.

2. A misfire detector for use in an internal combustion engine as recited in claim 1, wherein the current flowback is selected from the group consisting of a check diode and a series gap, the check diode being connected between the ignition coil and a distributor, and the series gap being formed as a rotor gap of a distributor.

3. A misfire detector for use in an internal combustion engine as recited in claim 1, wherein the spark plug voltage characteristic detector means distinguishes the voltage waveform of more than a predetermined reference voltage level (Vo) to deform the voltage waveform into output signals, each of which is proportional to the attenuation time period.

4. A misfire detector for use in an internal combustion engine as recited in claim 1, wherein the spark plug voltage characteristic detector means is adapted to determine a reference voltage from a peak value of a charged voltage in the stray capacity so as to detect an attenuation time period of the spark plug voltage waveform.

* * * * *